US005462379A

United States Patent [19]

Masumoto et al.

[11] Patent Number: 5,462,379

[45] Date of Patent: Oct. 31, 1995

[54] APPLICATOR HAVING CAP WHICH PRESSURIZES AND SEALS INNER SPACE

[75] Inventors: Yasuhiro Masumoto; Isao Shimada, both of Tokyo, Japan

[73] Assignee: Sailor Pen Co., Ltd., Tokyo, Japan

[21] Appl. No.: 250,019

[22] Filed: May 27, 1994

[30] Foreign Application Priority Data

Aug. 31, 1993 [JP] Japan ..... 5-051636 U
Oct. 22, 1993 [JP] Japan ..... 5-061553 U

[51] Int. Cl.[6] ..... B43K 9/00; B43K 7/00

[52] U.S. Cl. ..... 401/213; 401/187; 401/188 A; 401/214; 401/247

[58] Field of Search ..... 401/213, 214, 401/187, 188 A, 247

[56] References Cited

U.S. PATENT DOCUMENTS

| | | | |
|---|---|---|---|
| 1,848,358 | 3/1932 | Kratz | 401/187 |
| 4,086,011 | 4/1978 | Kuparinen | 401/213 X |
| 4,334,622 | 6/1982 | Mutschler | 401/213 X |
| 5,154,526 | 11/1992 | Bothe | 401/247 X |
| 5,362,169 | 11/1994 | Hamamoto, et al. | 401/213 |

FOREIGN PATENT DOCUMENTS

| | | | |
|---|---|---|---|
| 222887 | 2/1990 | Japan | 401/213 |
| 25991 | 2/1990 | Japan | 401/213 |
| 270136 | 11/1950 | Switzerland | 401/213 |

*Primary Examiner*—Steven A. Bratlic
*Attorney, Agent, or Firm*—Frishauf, Holtz, Goodman, Langer & Chick

[57] ABSTRACT

An inexpensive applicator in which the air within the inner barrel of a cap enters the fluid tank of the applicator to increase the internal pressure thereof in the process where the cap is engaged with the neck of the applicator, so that the fluid tank need not be pressed between the fingers for application of the fluid to be applied, the cap having in the inner barrel thereof a cylindrical valve member made of a highly flexible material and provided with a diaphragm or with a diaphragm having a ball-like portion formed thereon, and the application member being designed to be retracted and spaced from the caulked front edge of the tip when the application member is abutted against the diaphragm or the ball-like portion of the valve member in the process where the cap is engaged with the body of the applicator, whereas the elastically deformed diaphragm or the ball-like portion of the valve member is designed to close the front end opening of the tip when the cap is fully engaged with the neck.

6 Claims, 5 Drawing Sheets

APPLICATOR HAVING CAP WHICH PRESSURIZES AND SEALS INNER SPACE

BACKGROUND OF THE INVENTION

This invention relates to an applicator to which a highly viscous fluid to be applied such as a correction fluid, a make-up fluid, an adhesive and a paint is charged.

In an applicator having a spherical form of application member (application ball), a tip is attached to the neck formed at one end of a fluid tank which is filled with a fluid to be applied, and the tip bears rotatably therein an application ball in such a way that the application ball may partly be exposed from the front edge thereof like a ballpoint pen. The application ball is resiliently urged by a spring so as to bring the application ball into intimate contact with the caulked front edge of the tip, whereby to allow the application ball and the front edge of the tip to form a valve structure, preventing the fluid to be applied from being discharged, when the applicator is not used.

When the application ball is pressed against a surface to be treated for application of the fluid, the application ball retracts against the resilience of the spring to provide a clearance between the application ball and the front edge of the tip, allowing the fluid deposited to the hidden portion of the application ball locating within the tip to be delivered through the clearance to the outside of the tip for application as the application ball is rolled. However, since the fluid has high viscosity, the fluid cannot normally be fed fully to the surface of the application ball. Accordingly, the fluid tank is molded by blowing using a flexible material to be squeezable, and the fluid tank is pressed between the fingers to increase the internal pressure of the fluid tank for application of the fluid to allow the fluid to be fed to the surface of the application ball with the aid of the thus increased pressure.

Meanwhile, in the case where the application member is rod-shaped, a tapered portion is formed at the middle of the application member, and the tapered portion of the application member being resiliently urged by a spring is brought into intimate contact with the caulked front edge of the tip to form a valve structure between the rod-shaped application member and the front edge of the tip, so that the fluid to be applied may not be discharged. When the application member is pressed against the surface to be treated, the application member retracts against the resilience of the spring to provide a clearance between the tapered portion of the application member and the front edge of the tip. Then, the fluid tank is pressed between the fingers so as to increase the internal pressure of the fluid tank, and thus the fluid is fed to the application member and can be applied to the surface to be treated.

As described above, the prior art applicators are inconvenient and troublesome to use since the fluid tank must be pressed between the fingers to increase the internal pressure of the tank for application of the fluid, and besides the production cost elevates since the fluid tank must be molded by blowing using a flexible material.

Therefore, if a cap is designed to be able to be push-fitted to the neck of the fluid tank with the front edge of the tip being sealed with the inner barrel of the cap and to reduce the volume of the sealed space defined within the inner barrel, in the process that the cap is engaged with the neck, the internal pressure of the inner barrel can be increased. Accordingly, the air in the inner barrel enters into the fluid tank to increase the internal pressure of the fluid tank, and thus the fluid tank need not be pressed between the fingers for application of the fluid to be applied.

However, since the application ball is resiliently urged by the spring, the application member must be retracted against the resilience of the spring so as to allow the air in the inner barrel to enter into the fluid tank. Accordingly, the internal pressure of the inner barrel must sufficiently be increased. In other words, while the push fitting stroke of the cap in the state where the inner barrel thereof is sealing the front edge of the tip must be increased, the longer the inner barrel of the cap becomes, the more difficult and inconvenient the pressurizing operation, becomes.

OBJECT AND SUMMARY OF THE INVENTION

Therefore, the present invention is directed to provide an applicator at a low production cost which allows easy entry of the air within the inner barrel of the cap into the fluid tank, when the cap is engaged with the neck, to increase the internal pressure of the fluid tank and which requires no pressing of the fluid tank between the fingers for application.

In order to attain the intended objects, the applicator according to the present invention has an application member retained in a tip such that the application member may partly be exposed from the front end opening of the tip, a spring for resiliently urging the application member to be abutted against the caulked front edge of the tip, a fluid tank in which a highly viscous film-forming fluid to be applied is contained and a neck formed contiguous to said fluid tank in which the tip is held, the outer circumference of the neck being in intimate contact with the inner circumference of the inner barrel of the cap so as to seal the tip; wherein the cap has in the inner barrel thereof a cylindrical valve member provided with a diaphragm; and the application member is designed to retract from the caulked front edge of the tip when the application member is abutted against the diaphragm of the valve member in the process where the cap is engaged with the neck, whereas the elastically deformed diaphragm of the valve member is designed to close the front end opening of the tip when the cap is fully engaged with the neck of the applicator.

Alternatively, a ball-like portion may be formed integrally with the diaphragm of the valve member, so that the application member may be retracted and spaced from the caulked front edge of the tip in the process where the cap is engaged with the neck of the applicator; whereas the front end opening of the tip may be closed by the elastically deformed ball-like portion of the valve member when the cap is fully engaged with the neck.

More specifically, since the application member is abutted against the ball-like portion of the diaphragm of the valve member in the process that the cap is engaged with the neck, the application ball is retracted to be spaced from the caulked front edge of the tip to open the valve mechanism. Accordingly, the pressurized air in the inner barrel readily enters into the fluid tank to increase the internal pressure of the fluid tank. Since the diaphragm of the valve member undergoes a considerable elastic deformation to close the front end opening of the tip after the cap is fully engaged with the neck, the increased internal pressure of the fluid tank can be maintained, so that the fluid tank need not be pressed between the fingers for application of the fluid contained therein, and besides the fluid tank need not be molded by blowing using a flexible material but can be injection molded using an ordinary rigid synthetic resin, so that the applicator can be produced inexpensively.

In the case where a ball-like portion is formed integrally with the diaphragm of the valve member, the application member is abutted against the ball-like portion of the valve member, so that the application ball is retracted and spaced from the caulked front edge of the tip to open the valve mechanism; whereas the ball-like portion of the valve member undergoes a great elastic deformation to close the front end opening of the tip. However, since the portion of the valve member to be abutted against the application member has a spherical form, it takes a longer time until the ball-like portion is greatly elastically deformed, after valve opening, to close the front end opening of the tip than in the planar diaphragm, and thus the internal pressure of the fluid tank can efficiently be increased.

BRIEF DESCRIPTION OF THE DRAWINGS

The features of this invention that are believed to be novel are set forth with particularity in the appended claims. The invention, together with the objects and advantages thereof, may best be understood by reference to the following description of the preferred embodiments taken in conjunction with the accompanying drawings in which:

DETAILED DESCRIPTION OF PREFERRED EMBODIMENTS

Figure 1:
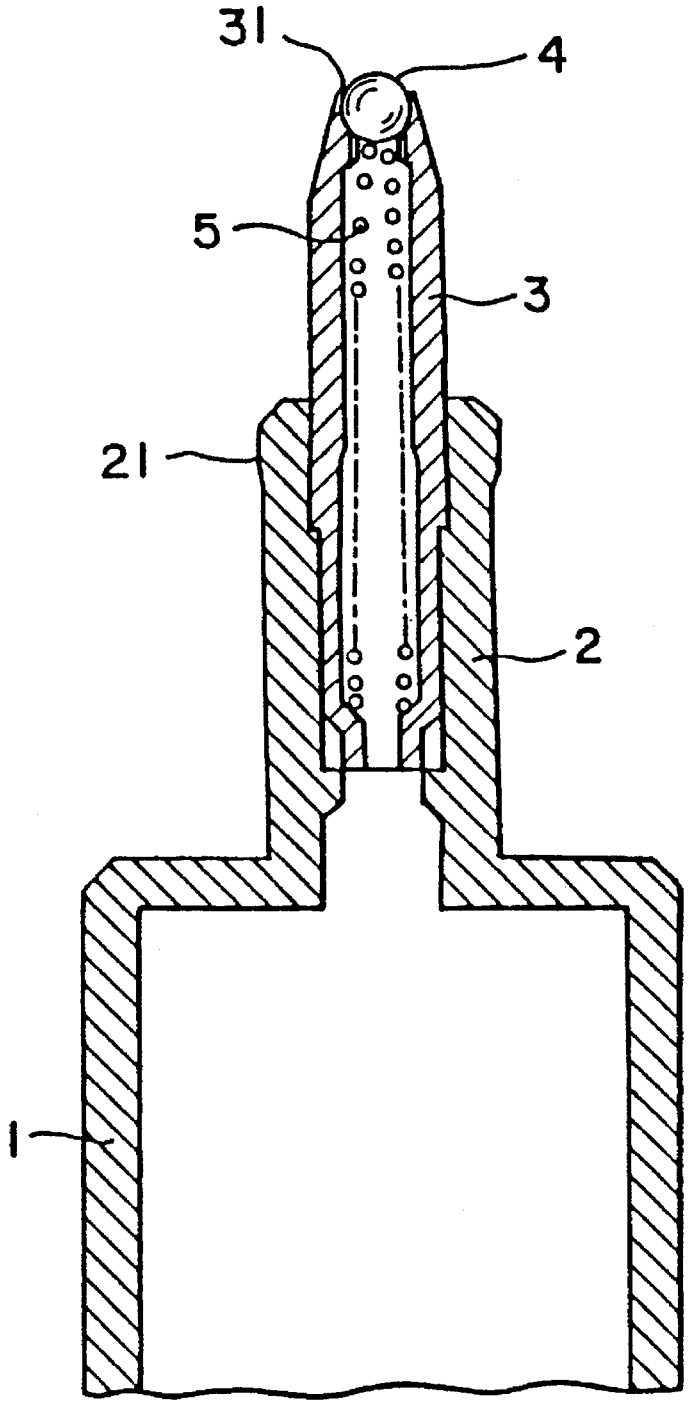
FIG. 1 shows a cross-sectional view of an applicator.

The present invention will now be described below specifically based on the embodiments shown in the attached drawings. In FIG. 1, a tip 3 is fitted in the front end opening of a neck 2 having an annular ridge 21 formed along the front end portion thereof. The tip 3 is made of stainless steel and has a bullet-like form. A ball housing is defined in the front end portion of the tip 3, which bears rotatably therein an application ball 4 comprising a 1.0 mm diameter hard ball in such a way that the application ball 4 may partly be exposed from the front edge of the tip 3. Incidentally, the tip 3 may be of a metallic pipe.

A small spring 5 having a spring force of 40 g is disposed in the tip 3 and resiliently urges the application ball 4 to be in press contact with the caulked front edge 31 of the tip 3 to constitute a valve mechanism between the application ball 4 and the front edge 31 of the tip 3. The neck 2 is formed integrally with a fluid tank 1. The fluid tank 1 is injection molded using an ordinary rigid synthetic resin which can be produced at a low production cost compared with those molded by blowing using flexible materials. A fluid to be applied, for example, a correction fluid having a high film-forming property with a viscosity of 30 to 40 cps is charged in the fluid tank 1 throughout the cavities in the neck 2 and the tip 3.

Figure 2:
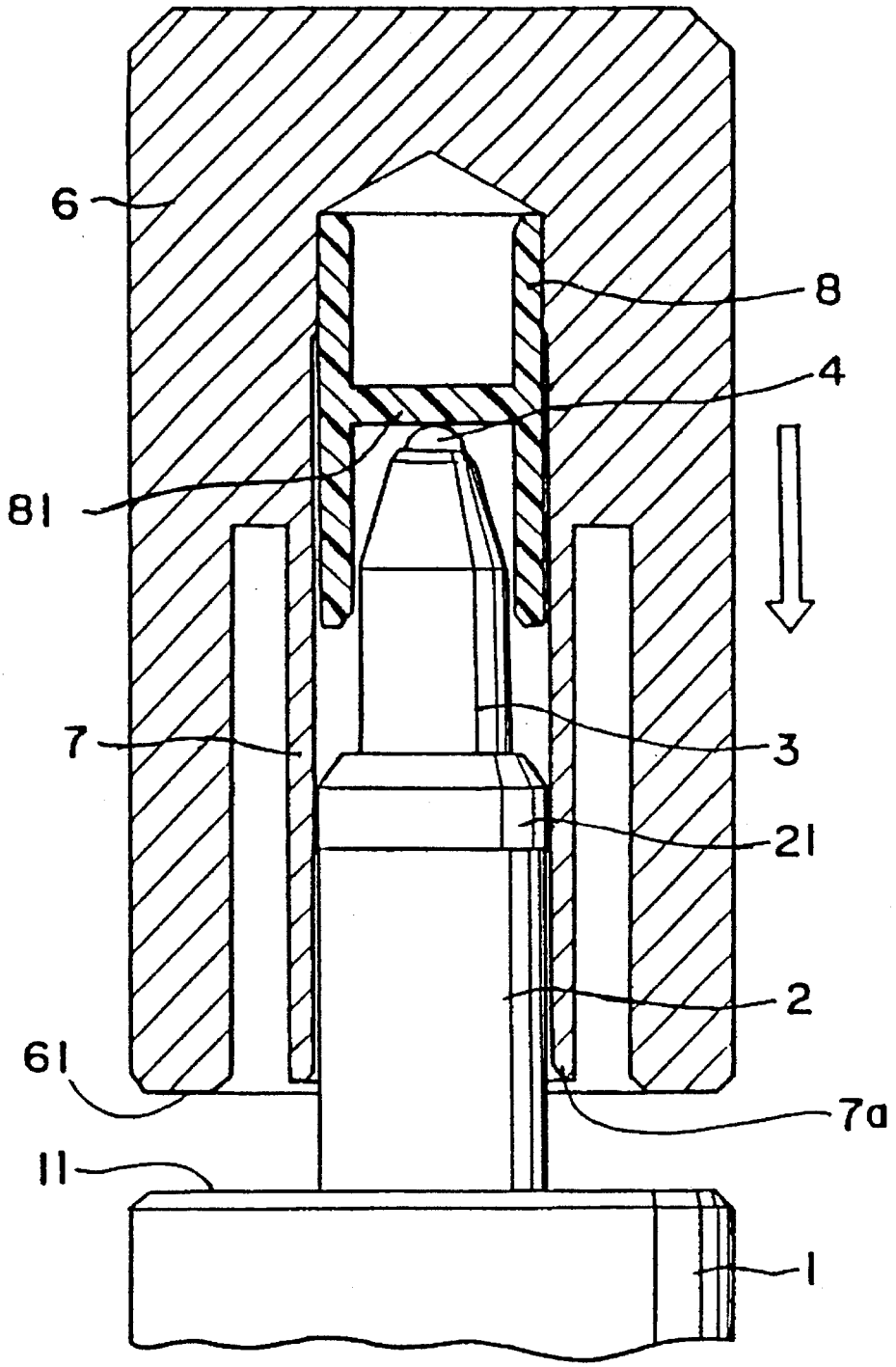
FIG. 2 shows an explanatory view where a cap is being engaged with the applicator.

A cap 6, which is molded using a synthetic resin, has an inner barrel 7 formed integrally therein, as shown in FIG. 2. A hermetically sealed space is defined in the inner barrel 7 by bringing the inner circumference at the front edge 7*a* of the inner barrel 7 into intimate contact with the annular ridge 21 of the neck 2. The inner barrel 7 has a valve member 8 molded using a highly flexible material disposed therein. The valve member 8 has a cylindrical form with a diaphragm and also has an H-shaped cross section. The valve member 8 having such H-shaped cross section can easily be incorporated into the cap 6, since it can axially be orientated in either direction. However, the valve member 8 may be of a cylinder having a U-shaped cross section, in which a diaphragm 81 is formed at the upper end thereof.

Thus, the front edge 7*a* of the inner barrel 7 is brought into intimate contact with the annular ridge 21 of the neck 2, in the process where the cap 6 is engaged with the neck 2, to provide a hermetically sealed space within the inner barrel 7. By pushing the cap 6 further in this state in the direction shown by the arrow, the inner circumference of the inner barrel 7 slides under intimate contact with the annular ridge 21 to reduce the volume of the sealed space in the inner barrel 7, and thus the air within the inner barrel 7 is pressurized. While the application ball 4 is thus abutted against the diaphragm 81 of the valve member 8, as shown in FIG. 2, the application ball 4 is forced to retract by the force of the valve member 8 if the cap is pushed further. Namely, a clearance is provided between the application ball 4 and the front edge 31 of the tip 3 to allow the air within the inner barrel 7 to enter into the fluid tank 1 and increase the internal pressure of the fluid tank 1.

Figure 3:
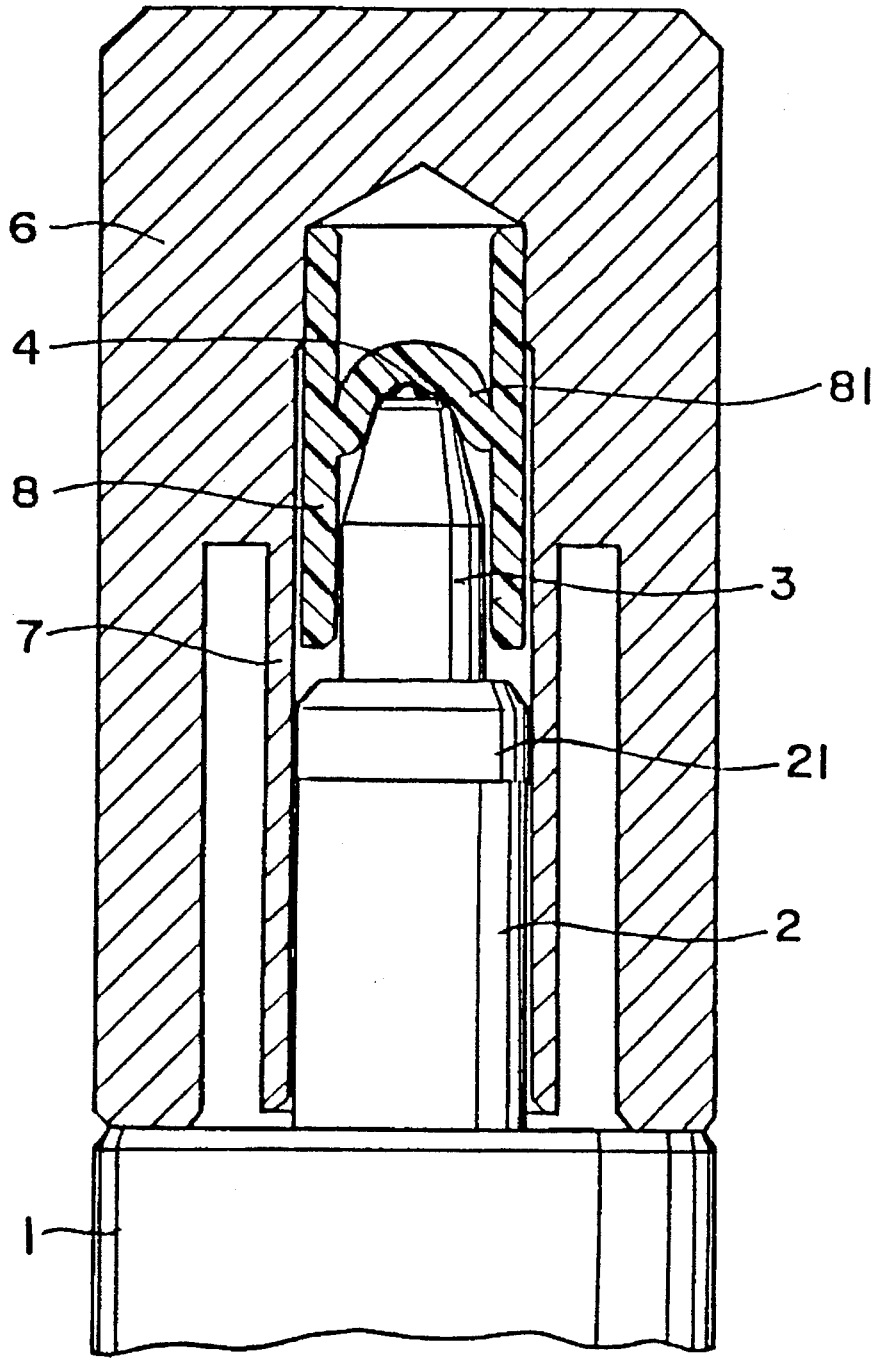
FIG. 3 shows an explanatory view where the cap is fully engaged with the applicator.

When the cap 6 assuming the state shown in FIG. 2 is further pushed to allow the abutment 61 of the cap 6 to abut against the step 11 of the fluid tank 1, the cap 6 is fully engaged with the neck 2, as shown in FIG. 3. In this state, the diaphragm 81 of the valve member 8 molded using a highly flexible material undergoes a considerable elastic deformation to close the front end opening of the tip 3, and thus the increased pressure in the fluid tank 1 can be maintained.

Figure 4:
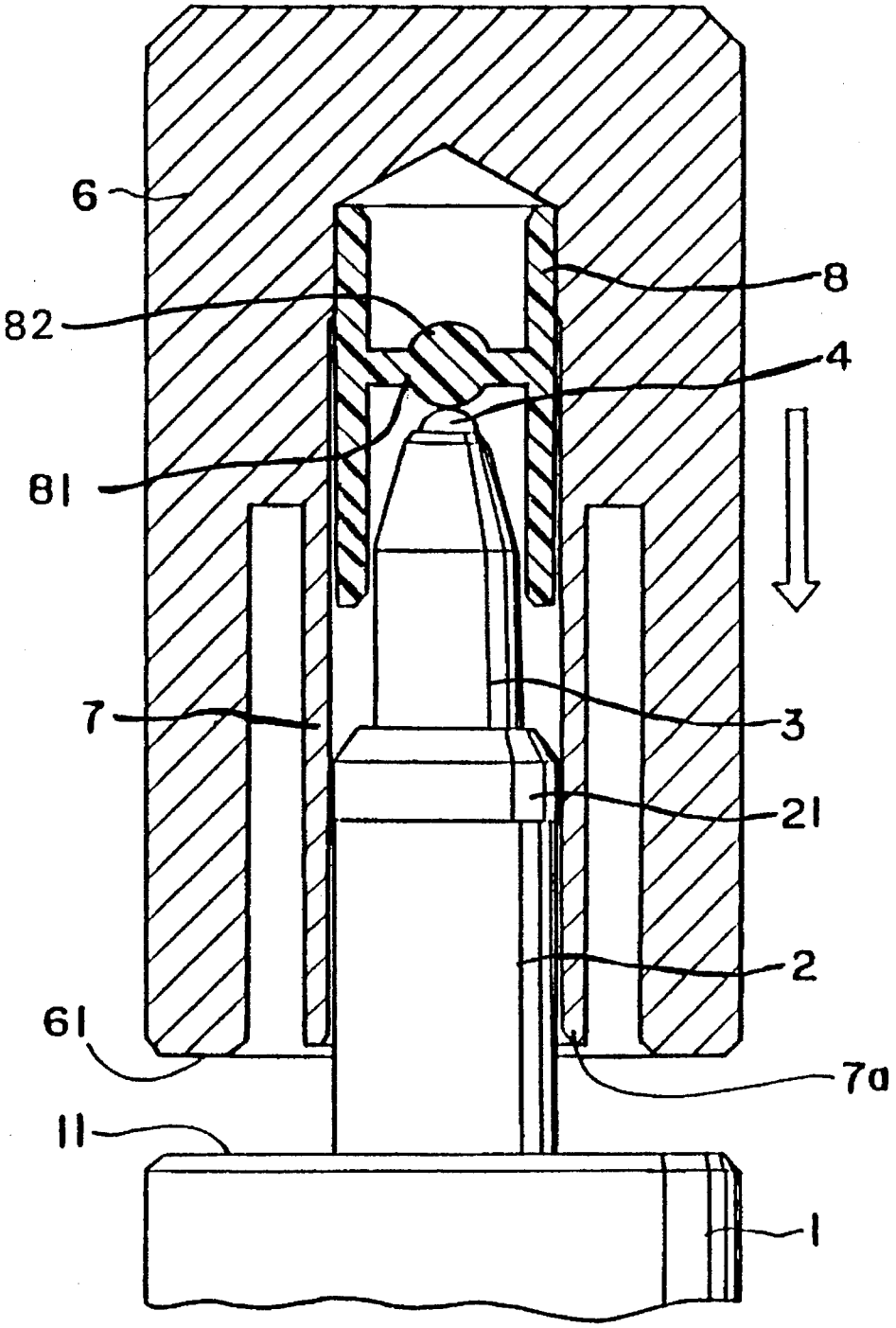
FIG. 4 shows an explanatory view where a cap according to another embodiment of the invention is being engaged with the applicator.
Figure 5:
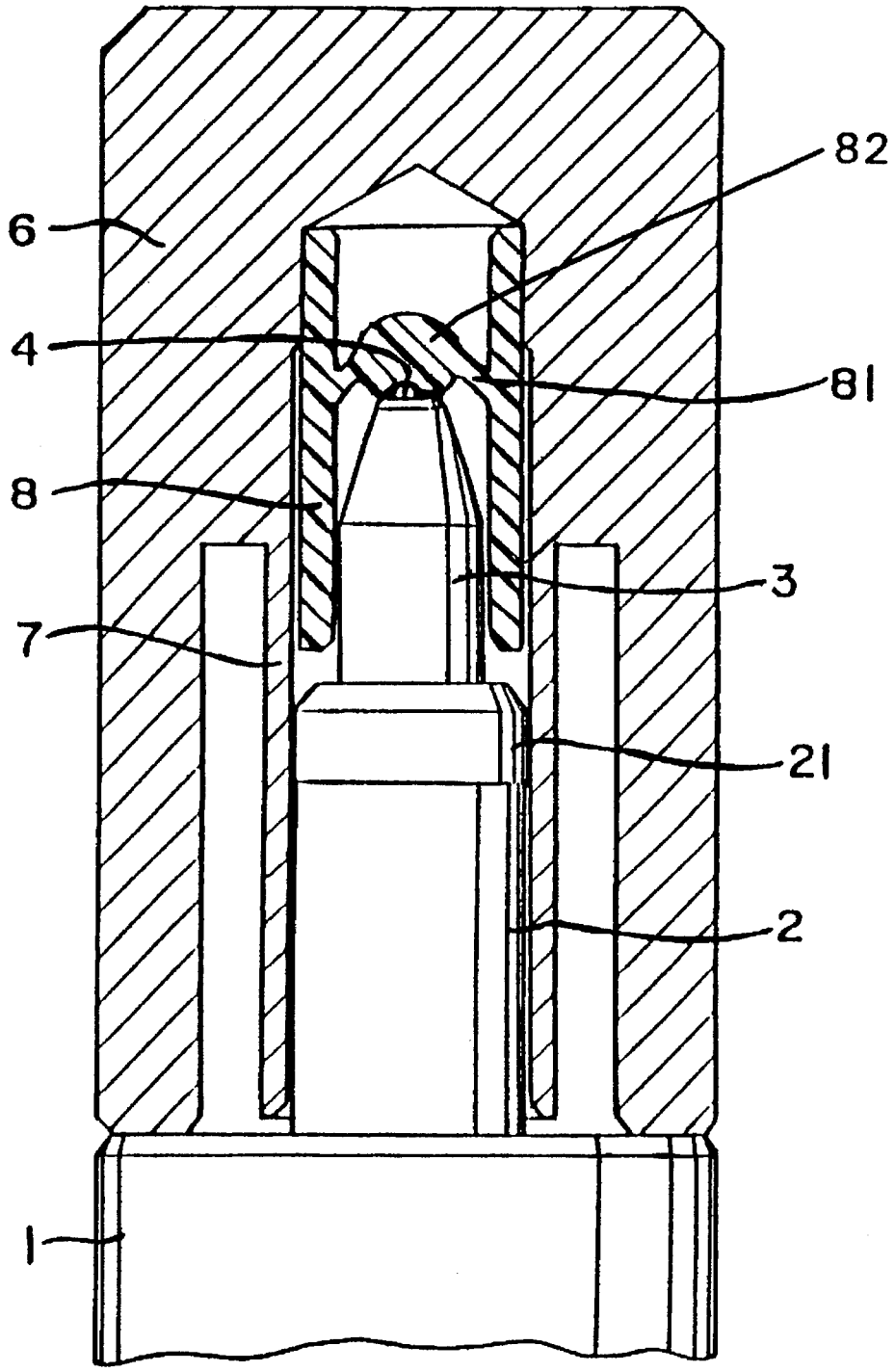
FIG. 5 shows an explanatory view where the cap shown in FIG. 4 is fully engaged with the applicator.

Next, another embodiment of the invention will be described referring to FIG. 4. The structure of the cap 6 is the same as in FIG. 2, but a valve member 8 disposed therein has a central ball-like portion 82 formed integrally with the diaphragm 81 thereof. Thus, the application ball 4 is brought into contact with the ball-like portion 82 in the process where the cap 6 is engaged with the neck 2, but if the cap 6 is pushed against the neck 2 of the valve member in this state, the application ball 4 retracts by the force of the valve member 8 to provide a clearance between the application ball 4 and the front edge 31 of the tip 3, whereby to allow the air in the inner barrel 7 to enter into the fluid tank 1 and increase the internal pressure of the fluid tank 1. When the cap 6 assuming the state shown in FIG. 4 is further pushed to allow the abutment 61 of the cap 6 to abut against the step 11 of the fluid tank 1, the cap 6 is fully engaged with the neck 2, as shown in FIG. 5. In this state, the diaphragm 81 and the ball-like portion 82 of the valve member 8 molded using a highly flexible material undergo considerable elastic deformations to close the front end opening of the tip 3.

Since the portion of the diaphragm 81 to be abutted against the application ball 4 is spherical (ball-like portion 82), it takes a longer time until the ball-like portion is elastically deformed, after valve opening, to close the front end opening of the tip than in the planar diaphragm, and thus the internal pressure of the fluid tank can efficiently be increased.

When engagement of the cap 6 is completed as described above, the air within the inner barrel 7 is allowed to readily enter into the fluid tank 1 and increase the internal pressure of the fluid tank 1 without increasing the internal pressure of the inner barrel 7 so much. Accordingly, when the fluid contained in the fluid tank 1 is to be applied after removal of the cap 6, the fluid can fully be fed to the application ball 4. Namely, the fluid tank 1 need not be pressed between the fingers, and the fluid can securely be applied to the surface to be treated in the same manner as writing with a ballpoint pen.

In the embodiments described above, the application members have spherical forms. However, the application members may be of a rod-like shape having a tapered portion at the middle.

As has been described heretofore, in the applicator according to the present invention, since the application member is designed to be abutted against the diaphragm of the valve member of the ball-like portion formed on the diaphragm thereof, in the process where the cap is engaged with the neck, to be retracted and spaced from the caulked front edge of the tip to open the valve mechanism, the air pressurized within the inner barrel can readily enter into the fluid tank to increase the internal pressure of the fluid tank; whereas the front end opening of the tip is closed by the elastically deformed diaphragm of the valve member or by the ball-like portion thereof to maintain the increased internal pressure of the fluid tank. Accordingly, the fluid tank need not be pressed between the fingers for application of the fluid contained therein, and besides the fluid tank need not be molded by blowing using a flexible material but can be injection molded using an ordinary rigid synthetic resin, so that the applicator can be produced inexpensively.

Although two embodiments of the present invention have been described herein, it should be apparent to those skilled in the art that the present invention may be embodied in many other specific forms without departing from the spirit or scope of the invention.

What is claimed is:

1. An applicator comprising:

fluid tank means for containing a highly viscous film-forming fluid to be applied;

a neck formed contiguous with said fluid tank means and having an outer circumference;

a tip having a caulked front edge and held within said neck;

an application member retained in said tip such that said application member may be partly exposed from the front edge of said tip;

a spring for resiliently forcing said application member in abutting relation against the caulked front edge of said tip; and a cap for covering said tip, said cap including:

an inner barrel with an inner circumference in intimate contact with the outer circumference of said neck so as to seal said tip, a cylindrical valve member, and flexible diaphragm means in the cylindrical valve member for:

pushing said application member against the force of said spring so as to retract said application member from the caulked front edge of said tip during initial engagement of said cap with said neck when said cap is applied in covering relation to said tip such that a pressurized space in said cylindrical valve member pressurizes said fluid tank, and sealing the caulked front edge of said tip when said cap is fully engaged with said neck.

2. An applicator according to claim 1, wherein said application member is a ball rotatably retained in said tip.

3. An applicator according to claim 1, wherein said cylindrical valve member and said diaphragm means are integrally formed and have an H-shaped longitudinal cross-sectional configuration.

4. An applicator comprising:

fluid tank means for containing a highly viscous film-forming fluid to be applied;

a neck formed contiguous with said fluid tank means and having an outer circumference;

a tip having a caulked front edge and held within said neck;

an application member retained in said tip such that said application member may be partly exposed from the front edge of said tip;

a spring for resiliently forcing said application member in abutting relation against the caulked front edge of said tip; and a cap for covering said tip, said cap including:

an inner barrel with an inner circumference in intimate contact with the outer circumference of said neck so as to seal said tip, a cylindrical valve member, and flexible diaphragm means in the cylindrical valve member for:

pushing said application member against the force of said spring so as to retract said application member from the caulked front edge of said tip during initial engagement of said cap with said neck when said cap is applied in covering relation to said tip such that a pressurized space in said cylindrical valve member pressurizes said fluid tank, and sealing the caulked front edge of said tip when said cap is fully engaged with said neck, said diaphragm means including a ball-like portion which pushes said application member and which seals said caulked front edge.

5. An applicator according to claim 4, wherein said application member is a ball rotatably retained in said tip.

6. An applicator according to claim 4, wherein said cylindrical valve member and said diaphragm means are integrally formed and have an H-shaped longitudinal cross-sectional configuration.

* * * * *